US006188837B1

(12) United States Patent
Kwan

(10) Patent No.: US 6,188,837 B1
(45) Date of Patent: Feb. 13, 2001

(54) HAND-HELD HAIR DRYER WITH RETRACTABLE CORD AND CONTROLLER RESPONSIVE TO AMOUNT OF CORD CARRIED ON CORD REEL

(75) Inventor: Koon-Chi Kwan, Kowloon (HK)

(73) Assignee: China Pacific Trade Ltd. (VG)

( * ) Notice: Under 35 U.S.C. 154(b), the term of this patent shall be extended for 0 days.

(21) Appl. No.: 09/243,128

(22) Filed: Feb. 3, 1999

(51) Int. Cl.[7] ..... A45D 20/10
(52) U.S. Cl. ..... 392/385; 34/97
(58) Field of Search ..... 392/379–385; 34/96–101; 242/916, 405; 191/12.4, 12.2 R; 15/DIG. 10, 323

(56) References Cited

U.S. PATENT DOCUMENTS

| | | | | |
|---|---|---|---|---|
| 2,015,982 | * | 10/1935 | Witzel | 392/379 |
| 3,135,859 | * | 6/1964 | Mitter | 392/379 |
| 3,949,487 | * | 4/1976 | Bartram et al. | 34/99 |
| 4,293,759 | * | 10/1981 | Higgins | 392/379 |
| 4,528,440 | * | 7/1985 | Ishihara | 392/385 |
| 4,658,116 | * | 4/1987 | Tsang et al. | 392/385 |
| 5,351,417 | * | 10/1994 | Rubin | 34/90 |
| 5,784,800 | * | 7/1998 | Santhouse et al. | 34/97 |

FOREIGN PATENT DOCUMENTS

| | | | | |
|---|---|---|---|---|
| 459507 | * | 9/1968 | (CH) . | |
| 3728885 | * | 3/1989 | (DE) . | |
| 4429112 | * | 1/1995 | (DE) . | |
| 38452 | * | 10/1981 | (EP) . | |
| 2055573 | * | 3/1981 | (GB) | 392/385 |
| 4-105628 | * | 4/1992 | (JP) . | |
| 5-291926 | * | 11/1993 | (JP) . | |
| 7-171079 | * | 7/1995 | (JP) . | |

* cited by examiner

*Primary Examiner*—John A. Jeffery
(74) *Attorney, Agent, or Firm*—Burns, Doane, Swecker & Mathis, L.L.P.

(57) ABSTRACT

A improved portable electric hair dryer comprises a retractable power cord storage reel (25) which is placed intermediately between the inlet (22) and outlet (21) of the hair dryer with the median plane of the power cord reel (25) substantially normal to the axis of the barrel (20). The hair dryer is provided with a controller which protects the hair dryer from overheating due to blockage of the air-passageway between the inlet and outlet as a result of the loaded power cord reel. The controller causes the power supply to the hair dryer to be cut off when its sensing unit detects a amount of power cord (40) being carried on the cord reel (25) exceeds a safe limit. This hair dryer is also provided with a hand sensor (31) so that power supply will be cut of when an operating hair dryer is left un-attended. An ionizer is also provided on the hair dryer so that the blown dried hair has less affinity for dust.

5 Claims, 4 Drawing Sheets

HAND-HELD HAIR DRYER WITH RETRACTABLE CORD AND CONTROLLER RESPONSIVE TO AMOUNT OF CORD CARRIED ON CORD REEL

FIELD OF THE INVENTION

The present invention relates to hand-held hair dryers and, more particularly, to hand-held hair dryers with a built-in retractable power cord reel.

BACKGROUND OF THE INVENTION AND PRIOR ART

Hand-held hair dryers are probably one of the most widely used electrical appliances known to-date and they can be found in almost every home in the developed world. Because of its usually high power consumption rate of 1–2 kW, a hair dryer is usually equipped with a flexible power cord for connection to the mains power supply. While a long power cord is desirable to provide high mobility so that the hair dryer can be used at a distance from the mains outlet, an excessive length of un-restrained power cord accessible to young children is however already known to be a source of potential domestic hazards.

Furthermore, it is well known that the power cords from adjacently stored corded appliances tend to entangle together and it would be difficult to separate the entangled power cords. As there are ever-increasing varieties of corded electrical appliances, this is an annoying phenomenon which a designer of electric appliances need to consider in the development of new appliances.

To alleviate the aforementioned problems, it is desirable that a built-in power cord storage device is provided on a hair dryer so that the excessive length of power cord can be restrained and stored on the dryer, especially when the dryer is not in use. In addition, a desirable power cord storage device should preferably provide a controlled release of the stored power cord so that only a desired length of cord is released while the remaining portion is kept on the dryer.

Portable hair dryers with retractable power cord storage devices are already known. U.S. Pat. Nos. 4,528,440 and 5,784,800 issued respectively to Ishihara and Santhouse et al. represent better known types of them.

The former type is characterized by a laterally mounted power cord storage device which results in a lack of symmetry about the vertical plane. This lack of symmetry leads to a two-fold disadvantage—a user would have to hold the dryer firmly upright to prevent tilting and that left- and right-hand versions would have to be supplied to better suit different users.

The latter type is characterized by a cord storage reel which is mounted in coaxial alignment with the elongate barrel inside the housing of the dryer. A main disadvantage of this latter arrangement is that many unsightly air vents are required on the sides of the hair dryer in order to provide alternative ventilation paths when the conventional air-ventilation paths, formed between ventilation holes at the rear of the hair dryer and the barrel exit, are blocked by the power cord being carried on the cord reel. The presence of such additional ventilation holes also means that water drops can get in more easily and cause electric faults.

As a conventional hair dryer is usually provided with electric coil heaters which are turned on or off by a toggle switch, potential fire hazards are often a major concern for families with young children who may accidentally or deliberately turn hair dryers on and leave them on. This is especially dangerous when the whole length of power cord is being stored on the cord reel inside the barrel, thereby substantially blocking the ventilating paths.

Furthermore, the affinity of blown dried hair for dust is another known shortcoming of conventional portable hair dryers with which designers of hair dryers need to be concerned if a more useful appliance is to be made available to the public.

OBJECT OF THE INVENTION

It is therefore an object of the present invention to provide an improved hair dryer with a built-in cord storage device which is substantially symmetrical about the vertical plane during use but alleviating the need of extra unsightly ventilating vents on the sides to provide secondary air-passageway to prevent overheating. It is another object of this invention to provide a hair dryer with means to alleviate fire hazards which may be caused by inadvertently or deliberately leaving a hair dryer on while un-attended. It is a further objective of the present invention to alleviate the known problem of dust affinity for blown dried hair. As a minimum, it is an object of the present invention to provide the public with an useful choice.

SUMMARY OF THE INVENTION

Accordingly, there is provided a portable hair dryer having a main housing with a length of flexible power cord in which the main housing comprises a barrel portion and a handle portion. Inside the barrel portion there are provided a motor driven fan and a power cord storage reel. The barrel portion has at least one aperture disposed at a rear end through which external air enters said barrel and a nozzle disposed at a front end through which air leaves said barrel; the power cord reel is disposed intermediate of said front and rear ends with a median plane substantially normal to the axis of said barrel; the hair dryer has a control means operable by the amount of flexible power cord being carried on said power cord reel to turn off the power supply to at least a portion of said hair dryer when the length of power cord being carried on said cord reel exceeds a predetermined amount.

Preferably, the control means of the aforementioned hair dryer comprises a sensing means and a switching means, said sensing means detects the amount of power cord being carried on said power cord reel and sends out a corresponding signal, said switching means receives said corresponding signal from said sensing means and will turn off power supply to at least a portion of said hair dryer when said corresponding signal reaches a pre-determined threshold.

As shown in the preferred embodiment, the sensing means preferably comprises an infra-red emitter and receiver pair, said emitter and receiver pair is normally in communication and is disposed diametrically across said power cord reel, said receiver is adapted to cause power supply to said hair dryer to be turned off when the communication between said emitter and receiver is sufficiently blocked by said power cord.

Preferably, the hair dryer further comprises a hand sensor for detecting the presence of a hand on the handle portion, wherein said hand sensor gives out a corresponding signal to turn said hair dryer off when the hair dryer is in operation and no hand is detected.

To avoid the problem of dust affinity for blown dried hair, it is preferred that the hair dryer is also provided with an ionizing means for ionizing the air surrounding the hair to be dried and neutralizes the electronic charge remaining on said hair so that it is less dust attractive.

According to a second aspect of this invention, there is provided a portable hair dryer having a main housing with a length of flexible power cord in which the main housing comprises a barrel portion and a handle portion and inside said barrel portion there are provided a motor driven fan, a power cord storage reel. The barrel portion has at least one aperture disposed at a rear end through which external air enters said barrel and a nozzle disposed at a front end through which air leaves said barrel; the handle portion is provided with a hand sensing means which detects the presence of a hand on the handle portion and gives out a corresponding signal when said hair dryer is in operation and no hand is detected at the handle portion.

BRIEF DESCRIPTION OF THE DRAWINGS

A preferred embodiment of the present invention will now be explained by way of example and with reference to the accompanying drawings in which.

DETAILED DESCRIPTION OF THE PREFERRED EMBODIMENT

Figure 1:
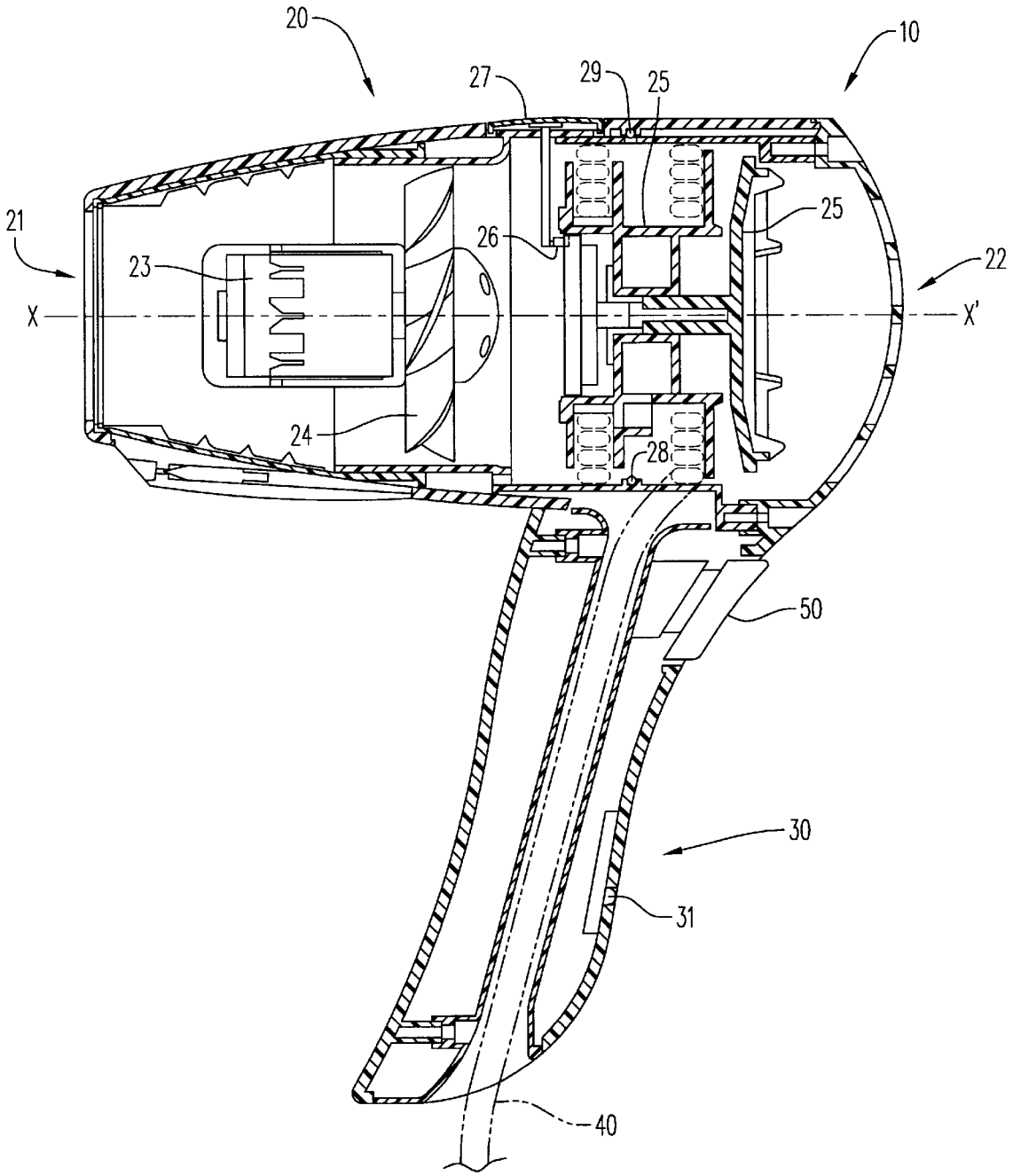
FIG. 1 shows a longitudinal cross-sectional view of a preferred embodiment of the present invention.
Figure 2:
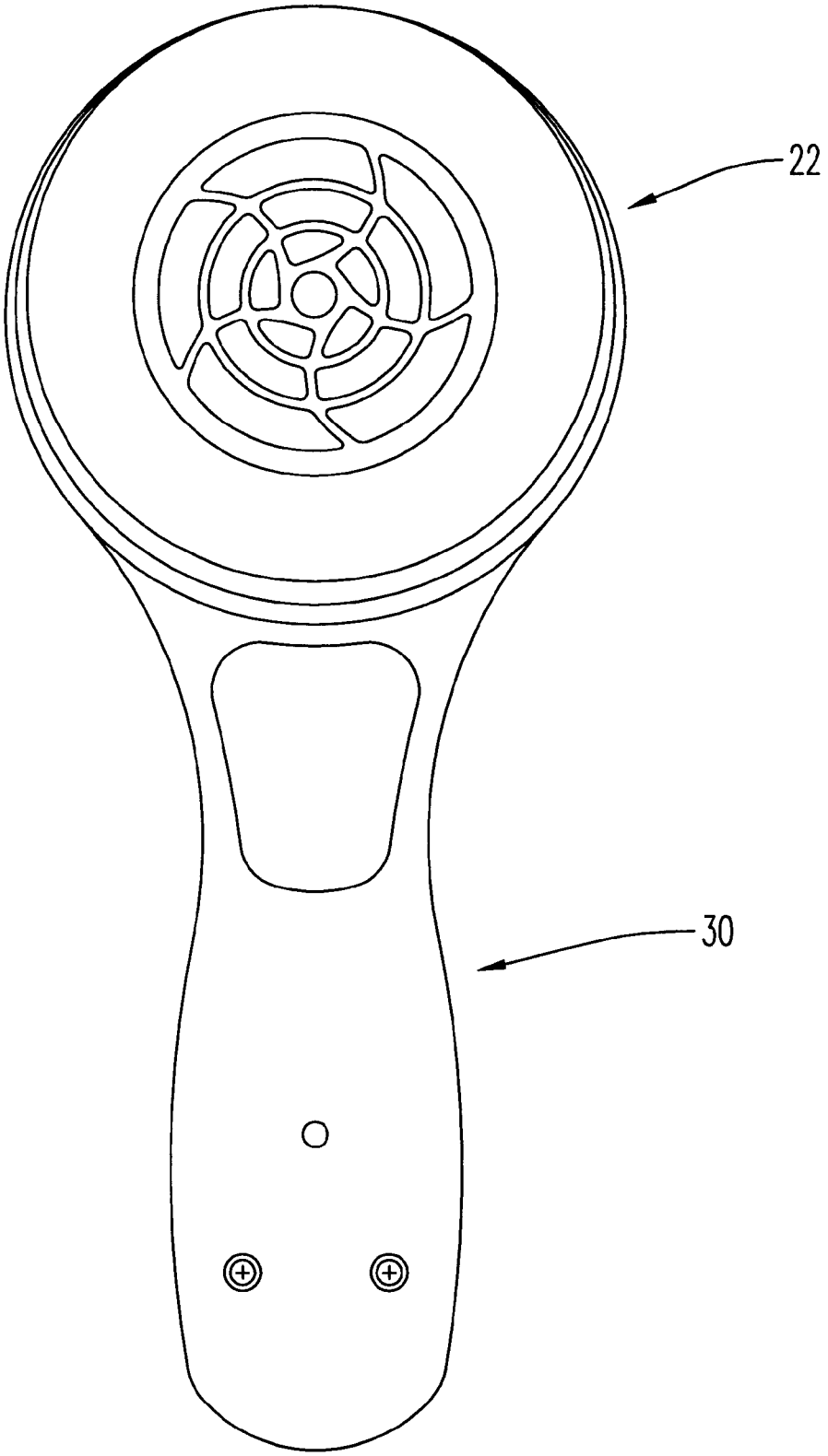
FIG. 2 shows a rear view of the embodiment of FIG. 1.
Figure 3:
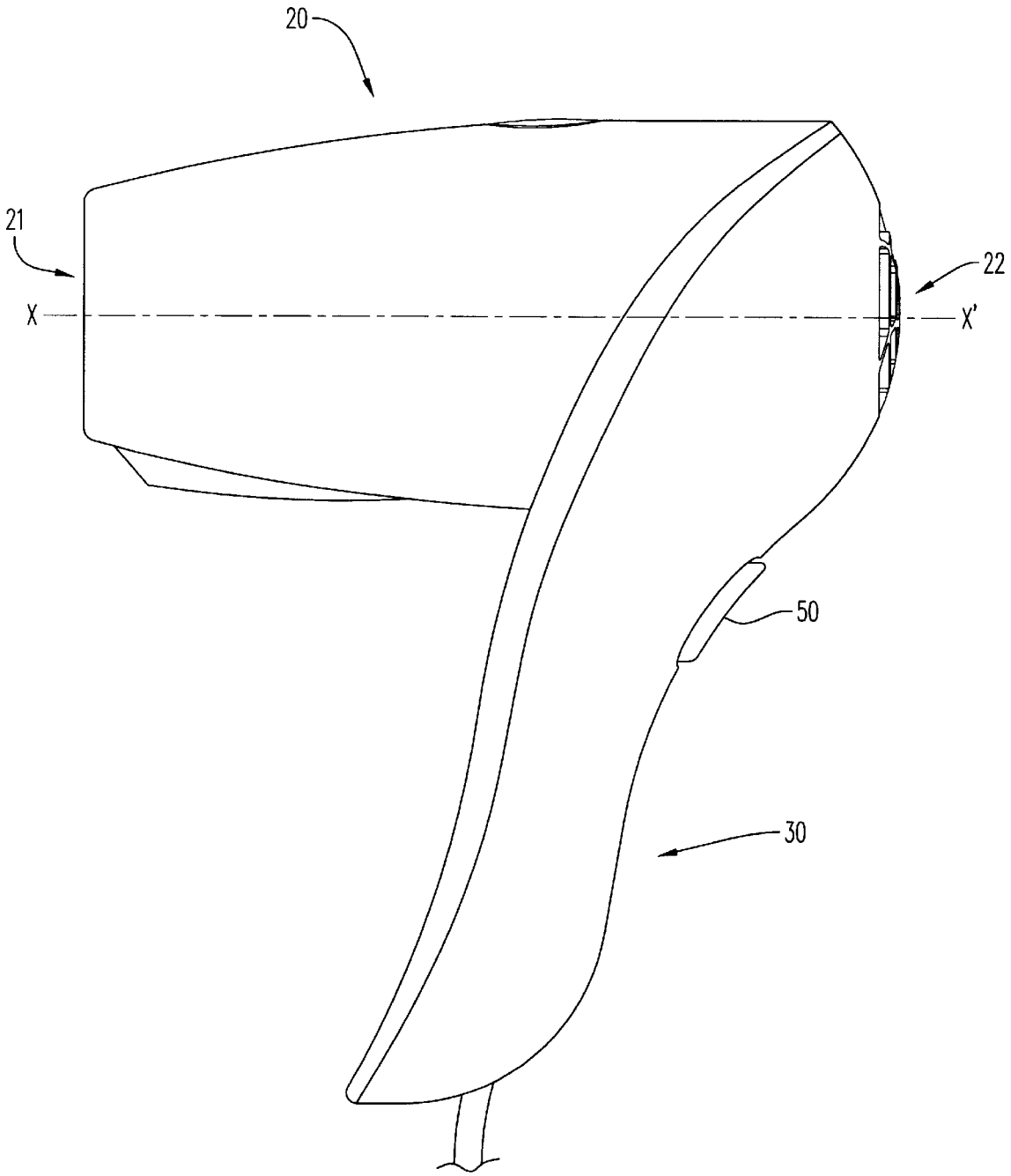
FIG. 3 shows the side view of the hair dryer of FIG. 1.
Figure 4:
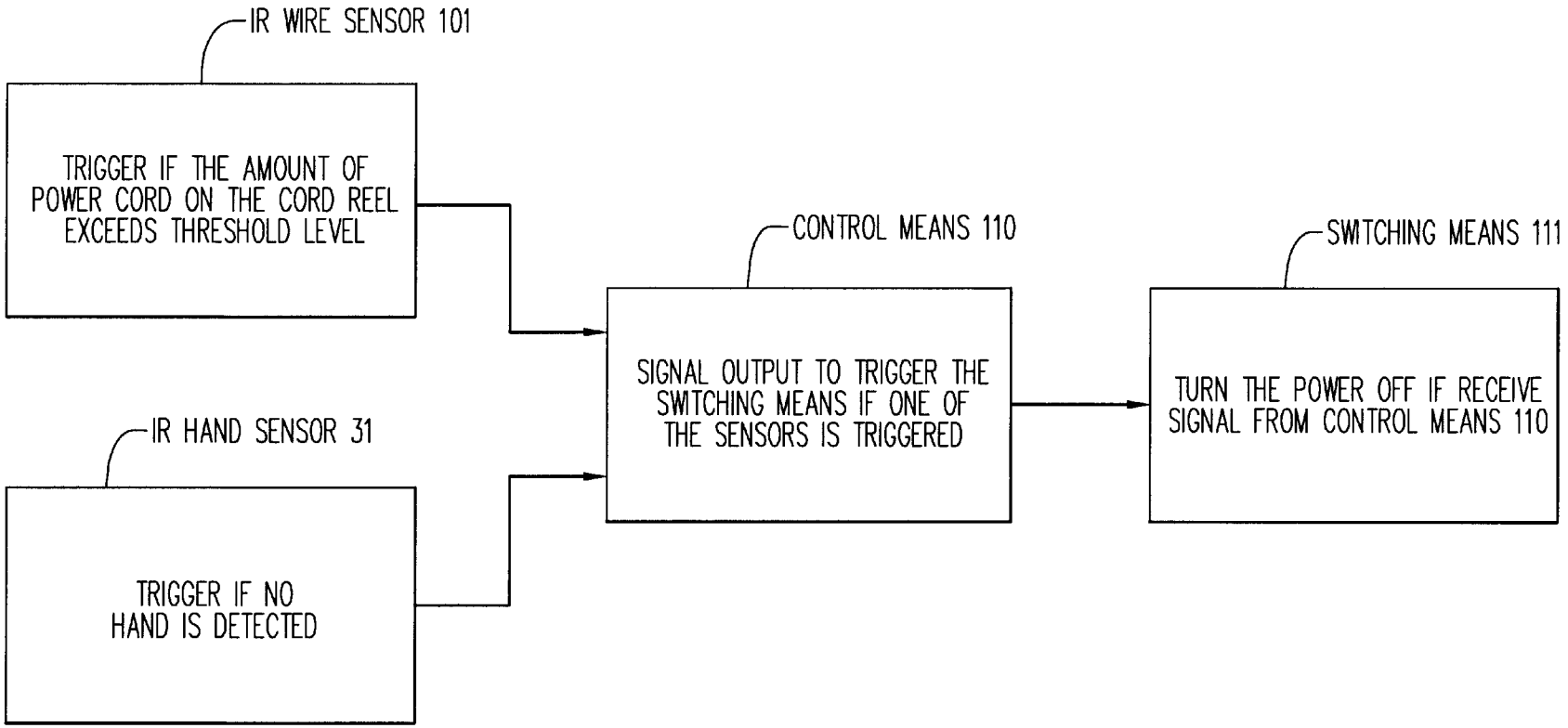
FIG. 4 shows the operation of the control means that turns off the hair dryer if the amount of power cord on the cord reel exceeds threshold level or no hand is detected.

Referring to the Figures, there is shown a preferred embodiment of a portable hair dryer 1. The hair dryer has a main housing 10 which comprises a barrel portion 20, a handle portion 30, a length of flexible power cord 40 and a main power switch 50. The barrel portion 20 is substantially cylindrical with a nozzle 21 formed at the front longitudinal end and a plurality of apertures 22 disposed at the rear longitudinal ends 21, 22. External air enters and leaves the hair dryer respectively through the rear and front apertures. A defined air-passageway is thus defined between the two longitudinal ends within the barrel. The barrel portion 20 is preferably tapered towards its front end so that the air-flow will be concentrated prior to leaving the barrel portion 20.

Inside the barrel portion there are mounted heater elements (not shown), a motor 23 driven fan 24 and a power cord storage reel 25. The heater elements are designed to provide optional heating to the air inside the barrel for better styling and quicker drying. The motor 23 driven fan 24 causes external air to enter the barrel through the rear air vents and to force the air inside the barrel 20 to leave the barrel through the front outlet 21. The electric motor 23 is preferably mounted with its shaft parallel to the axis of the cylindrical barrel portion so that the resulting air-flow is generally along the length of the barrel 20.

The power cord storage device provides temporary storage for the flexible power cord 40 when the dryer is not in use or when there is an excessive length of idle power cord so that the length of unrestrained power cord outside the dryer is reduced. The storage device is preferably a ratchet-type reel with a latching means 26 so that it will only allow the reel to rotate in a direction to release the cord being carried on it. The power cord reel 25 is usually provided at the rear portion of the barrel portion 20 with its median plane substantially normal to the axis (x-x') of the barrel so that the usually hot-meltable power cord is kept far away from the heating elements.

Furthermore, the cord reel is preferably provided with an automatic cord retract mechanism so that the released power cord can be collected at the touch of a button 27. This can for example be done by providing a spring loading mechanism on the power cord reel 25 which is designed according to conventional principles of mechanics so that sufficient energy is stored during release of the power cord. The stored energy is then released for collecting the power cord when the latching means 26 in connection with the button 27 is released. The latching means 26 is desirable so that the power cord is not retracted unless the user wants so. A spring biased ratchet assembly with a releasable catch is a typical example of conventional mechanical arrangements which is suitable for use in such a retract mechanism.

As the cord reel 25 is located between the two longitudinal ends 21, 22 of the barrel and within the main housing 10, the air-passageway inside the barrel will be narrowed down and even blocked when an increasing length of power cord is anchored on the cord reel 26. With the narrowing down of the air-passageway, there is an increasing risk of overheating inside the barrel 20 unless secondary air-passageways are provided to introduce air into the barrel 20. However, known hair dryers with secondary air-passageways always have unsightly air vents on the sides of the barrel which would also be allow entry of water drops and are therefore undesirable.

To avoid the risk of overheating due to blockage of the air-passageway by the stored power cord while alleviating the need of unsightly and undesirable air-vents, there is provided on the hair dryer a control means 110 which is designed to turn the power supply to the hair dryer or the heater elements off when the building-up of power cord on the cord reel will begin to cause overheating. Control means 110 may comprise separate sensing means 101 and switching means 111. Sensing means 101 includes a sensor which detects the amount of power cord being anchored on the power cord reel and gives a corresponding signal. Control means 110 will cause the power supply to be turned off when the signal given by the sensing means corresponds to a pre-determined threshold level representing onset of hazard.

Sensing means 101 used in the present embodiment comprises an infra-red emitter 28 and receiver 29 pair which is disposed across the diametric ends of the cord reel. This infra-red pair is normally in communication with each other. When the communication between the emitter-receiver pair is sufficiently blocked by the power cord stored on the cord reel, the receiver will send a signal to the control unit to turn off the power supply, thereby alleviating the possibility of overheating due to blockage of the air passageway.

To further enhance the safety features of this hair dryer, there is provided a hand sensor 31 on the handle portion which will give out a corresponding signal when the sensor detects that the handle portion of the hair dryer is not in contact with a human hand while the hair dryer is in operation. This is done in the present embodiment by using an infra-red sensor which is known to detect effectively the presence of a human hand by making reference to the received infra-red radiation. The infra-red hand sensor will give out a corresponding signal when the hair dryer is in operation but no presence of a hand is detected. It could of course be appreciated that other sensors, for example, thermo- or pressure-sensors, can be used in place of the infra-red sensor.

Furthermore, mechanical or other solutions could combine the sensing and switching mechanism into a single unit.

For example, a switch directly activated by the power cord building up to a pre-determined level could be utilized.

To alleviate the problems of dust affinity for blown dry hair, there is provided in the present embodiment an electronic ionizer 60 which will alleviate the affinity problem by ionizing the surrounding air and neutralizing the charge which would otherwise remain on the hair because of the static charge generated during hair drying and combing. The electronic ionizer is based on conventional ionizing circuitry and is installed near the nozzle portion of the dryer. Although the present invention has been described with reference to the above preferred embodiment, this is not to be considered limiting to the scope of the invention which is defined in the appended claims. Integers recited in the description are deemed to incorporate equivalents where appropriate to those skilled in the art to which the invention relates. In particular, while the present invention has been described with reference to a hair dryer having a substantially symmetric body about the vertical plane during use, it should be appreciated that the above-mentioned safety features, including the control means and the hand sensor, can be applied to other types of hair dryers with cord reels which are not symmetrically disposed about the vertical plane.

What is claimed is:

1. A portable hair dryer having a main housing with a length of flexible power cord, said main housing comprises a barrel portion and a handle portion, inside said barrel portion there are provided a motor driven fan and a power cord storage reel, wherein said barrel portion has at least one aperture disposed at a rear end through which external air enters said barrel and a nozzle disposed at a front end through which air leaves said barrel; said power cord reel is disposed intermediate of said front and rear ends with a median plane substantially normal to the axis of said barrel, characterized in that:

said hair dryer has a control means responsive to the amount of flexible power cord being carried on said power cord reel to turn off the power supply to at least a portion of said hair dryer when the length of power cord being carried on said cord reel exceeds a predetermined amount.

2. A hair dryer according to claim 1, characterized in that said control means comprises a sensing means and a switching means, said sensing means detects the amount of power cord being carried on said power cord reel and sends out a corresponding signal, said switching means receives said corresponding signal from said sensing means and will turn off power supply to at least a portion of said hair dryer when said corresponding signal reaches a pre-determined threshold.

3. A hair dryer according to claim 2, characterized in that said sensing means comprises an infra-red emitter and receiver pair, said emitter and receiver pair is normally in communication and is disposed diametrically across said power cord reel, said receiver is adapted to cause power supply to said hair dryer to be turned off when the communication between said emitter and receiver is sufficiently blocked by said power cord.

4. A hair dryer according to claim 1, further comprising a hand sensor for detecting the presence of a hand on the handle portion, wherein said hand sensor gives out a corresponding signal to turn said hair dryer off when the hair dryer is in operation and no hand is detected.

5. A hair dryer according to claim 1, further comprising an ionizing means, wherein said ionizing means ionizes the air surrounding the hair to be dried and neutralizes the electronic charge remaining on said hair so that it is less dust attractive.

* * * * *